US005333854A

United States Patent [19]

Woollard et al.

[11] Patent Number: 5,333,854

[45] Date of Patent: Aug. 2, 1994

[54] TENNIS BALL RETRIEVER AND RACQUET

[75] Inventors: Howard W. Woollard, P.O. Box 263, Barnstable, Mass. 02630; David C. Hart, Barnstable, Mass.

[73] Assignee: Howard W. Woollard, Barnstable, Mass.

[21] Appl. No.: 100,752

[22] Filed: Aug. 2, 1993

[51] Int. Cl.[5] ..... A63B 49/08

[52] U.S. Cl. ..... 273/73 R; 273/73 J

[58] Field of Search ..... 273/73 R, 73 C, 73 D, 273/73 E, 73 K, 73 J

[56] References Cited

U.S. PATENT DOCUMENTS

| | | | |
|---|---|---|---|
| 266,598 | 10/1882 | Alexander . | |
| 491,558 | 2/1893 | Hill . | |
| 1,540,823 | 6/1925 | Mairhofen . | |
| 1,830,520 | 11/1931 | Moyses . | |
| 2,801,875 | 8/1957 | McEvoy . | |
| 2,819,109 | 1/1958 | Borah . | |
| 3,401,970 | 9/1968 | Russell . | |
| 3,405,408 | 10/1968 | Baker . | |
| 3,412,897 | 11/1968 | Slater . | |
| 3,462,184 | 8/1969 | Russell . | |
| 3,870,300 | 3/1975 | Amendola . | |
| 3,874,666 | 4/1975 | Ross . | |
| 4,090,298 | 5/1978 | Rushforth . | |
| 4,114,881 | 9/1978 | Norton . | |
| 4,183,526 | 1/1980 | Brown | 273/73 R X |
| 4,210,327 | 7/1980 | Schubert . | |
| 4,334,707 | 6/1982 | Phillips . | |
| 4,979,742 | 12/1990 | DiFranco . | |
| 4,993,712 | 2/1991 | Urwin . | |
| 5,056,786 | 10/1991 | Bellettini . | |

FOREIGN PATENT DOCUMENTS

| | | | |
|---|---|---|---|
| 2539633 | 7/1984 | France . | |
| 2554724 | 5/1985 | France . | |
| 2591497 | 6/1987 | France | 273/73 R |
| 480051 | 4/1953 | Italy . | |
| 501523 | 11/1954 | Italy . | |
| 509811 | 6/1955 | Italy . | |
| 443501 | 3/1936 | United Kingdom . | |
| 2035185 | 6/1980 | United Kingdom . | |
| 8808732 | 11/1988 | World Int. Prop. O. | 273/73 R |

*Primary Examiner*—William E. Stoll

*Attorney, Agent, or Firm*—Richard P. Crowley

[57] ABSTRACT

A tennis ball retriever device for use at the handle end of a tennis racquet to retrieve tennis balls. The tennis ball retriever device including a cap having an open end with a recess and a plurality of teeth or pins extending inwardly from a peripheral wall inside the recess, the teeth or pins adapted to grasp the nap surface of the tennis ball. The tennis ball retriever device includes within the recess of the cap a compressible material such as a lightweight, flexible, foam material extending to the teeth or pins and adapted to move between a screening position wherein the pins or teeth are screened from catching on objects, and a retracted position wherein the tennis ball is inserted into the open end of the retriever, which compresses the material and exposes the teeth or pins for use in grasping the nap of the tennis ball.

11 Claims, 3 Drawing Sheets

TENNIS BALL RETRIEVER AND RACQUET

BACKGROUND OF THE INVENTION

There are a wide variety of ball retriever devices specifically designed and constructed, for example, for gripping and engaging or otherwise removably retaining a tennis ball. Tennis ball retriever devices are typically usually applied to the handle end of a tennis racquet and are for the purposes of retrieving tennis balls easily without the necessity of the player or user bending over to the court surface to pick up the ball. Typically, retrieval is achieved by holding the tennis racquet by its head and simply pressing down the handle onto the ball with the tennis ball retriever device in the handle end. The player then lifts the racquet, grasps the ball, and then removes the ball from the tennis ball retriever device. Tennis ball retriever devices are useful to any and all tennis players, although they have specific appeal to aging, less aggressive or occasional players, as well as overweight and pregnant players, which groups tend to find the constant bending and stooping over, which normal tennis ball retrieval requires, to be a tiring exercise. The employment of a tennis ball retriever device also greatly simplifies practice sessions, where multiple ball pickups are routine, and for the retrieval of tennis balls which are out of reach.

However, although a variety of tennis ball retriever devices exist in the prior art it is desired to provide for a new and improved tennis ball retrieval device, particularly a device which is designed to be an integral component of the tennis racquet—replacing the tennis racquet's standard butt cap with one of comparable size and rigidity, so as to keep intact the inherent balance and design of the tennis racquet on which the tennis ball retriever is installed. It is also desired to provide a tennis ball retriever device and the resulting tennis racquet which avoids the difficulties and disadvantages associated with prior art tennis ball retriever devices.

SUMMARY OF THE INVENTION

The invention relates to a tennis ball retriever device, and to a tennis racquet employing the device. In particular, the invention involves a tennis ball retriever device which may be substituted in place of the standard butt cap of a tennis racquet so as to substantially maintain the grip, feel and flex of the standard racquet, in which the tennis ball retriever device is employed.

The invention comprises a tennis ball retriever device for use at the handle end of a tennis racquet, which racquet is used with a tennis ball having a napped exterior surface. The tennis ball retriever device is adapted for removably grasping a portion of the exterior surface of the tennis ball, upon contact of the tennis ball with the tennis ball retriever device. The device comprises a cap, generally but not limited to a butt cap of standard size, weight, and form presently employed on tennis racquets, and generally an integrally plastic molded-type butt cap, with the cap having an open end, with a recess defined by a peripheral wall. Generally, the recess would take the form of a truncated cone, with the open end of polygonal dimensions. The device also includes teeth means to catch or grasp removably the nap of the tennis ball, and comprises a plurality of teeth or pin elements extending inwardly a short distance toward the axis of the tennis racquet from the peripheral wall of the cap, and is generally positioned perpendicular to the axis, to grasp or to catch the nap of the tennis ball, when the tennis retriever device is pressed downwardly against the tennis ball in use. The tennis ball retriever device also includes a compressible means within the cap recess, typically a material which extends generally to the teeth means to screen the teeth means from casual contact with objects such as clothing or hands of the user, such as the player's fingers. The compressible material is compressed inwardly into the recess upon contacting the tennis ball in use and retracts to expose the teeth means to the ball surface nap, so that with continued added downward pressure on the handle end of the tennis racquet, the teeth means engage the tennis ball nap, and the tennis ball is lifted and removably secured to the tennis ball retriever device on the tennis racquet, and then removed by the player's free hand. On removal, the compressible material within the recessed end extends outwardly to resume its screening position until the next tennis ball pickup is required.

The tennis ball retriever device of the invention is designed to be an integral component of the tennis racquet in which it is employed, in one embodiment replacing the racquet's standard butt cap with one of comparable size and rigidity, so that the feel, grip and flex of the racquet handle remains virtually unchanged with standard factory models. The tennis ball retriever device may be fitted in place of the standard butt cap at the point of racquet manufacture, or it can be easily used to replace a standard butt cap on any racquet after dealer delivery or retail sale simply by removing the handle grip wrapping and the original butt cap and fitting the tennis ball retriever device of the invention to the handle end and reapplying the wrap about the tennis ball retriever device. This operation can be accomplished by most individuals, or certainly by any tennis professional shop.

The cap employed in one embodiment may, for example, be an integrally plastic molded injected butt cap; however, the extreme end of the butt cap, normally closed in a standard butt cap of a tennis racquet, is left open to form a recess therewithin to accept the working parts of the tennis ball retriever device. Tennis ball retrieval employing the tennis ball retriever device is achieved through the employment of teeth means, which represent a plurality of teeth or metal pins spaced about the outer periphery of the wall of the cap, either in single or multiple rows, and generally uniformly arranged about the peripheral wall and extending inwardly toward the center or the axis of the cap, and generally perpendicular to the axis a short distance, sufficient to engage the nap of the tennis ball. The arrangement of the pin or teeth are set at the proper angle of a proper number and length to engage securely in a removable manner the nap of the tennis ball when contact with the teeth means and the tennis ball are made in use. The teeth means may comprise single or multiple rows of either plastic teeth or metal pins which may be separately positioned into the peripheral wall of the cap, or integrally molded into the peripheral wall of the cap, or be a molded multi-tooth ring which is inserted into the open end of the cap just below the wall rim. Generally, the teeth means are positioned just below the outer rim of the peripheral wall of the cap to allow for the best possible contact with the tennis ball, and generally the length of the teeth means which are comprised of metal or plastic pins, ranging from about an eighth to a quarter of an inch.

The tennis ball retriever device includes a compressible means within the recess of the cap, and typically a flexible compressible material such as a lightweight, easily compressible foam material, such as of a vinyl or urethane foam or which may also include fibrous type material, such as cotton or wool batten, or other flexible, easily compressible material, particularly a material which will move between a protective screen position for the teeth means and a retracted tennis ball grasping position. The compressible means screens the teeth means from contact from outside objects clothing, player's fingers and the like, and in one embodiment, for example, may include a recessed groove means toward the outer peripheral to permit the teeth means to lie within the groove, yet be surrounded on the lower surface and on the one end close to the adjacent end of the teeth means with the compressible material. The compressible material may completely fill the recess of the cap in one embodiment, or, if desired, may be placed in ring form, so that the center of the recess in the other end of the cap attached to the tennis racquet is visible by the player. This use of the material has the advantage of displaying a logo, color, graphics, or other additia or designs to one exposed end surface of the cap.

The tennis ball retriever device of the invention also provides for the application of a design, color graphics, or printing directly to the surface of the compressible means, such as by imprinting a manufacturer's logo on the exterior surface of the foam compressible means so that the logo will be visible at the tennis ball retriever working end, which provides a means to display graphic designs, company trademarks, logos or an individual's initials or cipher, which permits custom racquet applications. The tennis ball retriever device also optionally permits the employment of a separate, thin flexible sheet material containing a design or logo indicia on one surface to be placed adjacent the exterior surface of the compressible means, rather than directly on the compressible means, where that is not desirable, so that the thin, reflective plastic or cloth-type material may be employed with the indicia or logo, and then placed against the exterior surface of the compressible means, and generally within the ring of the teeth means, which again permits visible display of the logo or design at the open end of the tennis retriever device. Thus, the tennis retriever device of the invention, employing teeth means for catching or grasping the tennis ball nap surface, avoids the disadvantages and disabilities associated with the use of outwardly projecting, sharp teeth means associated with prior art tennis ball retriever devices through the employment of a compressible means and also permits the employment of a manufacturer's logo or design indicia or initials at the open butt end of the tennis ball retriever device.

The tennis ball retriever device may be manufactured and sold separately or manufactured as a component of the tennis ball racquet-type, which comprises a tennis racquet having a tennis handle secured to a tennis head, and wherein the tennis ball retriever device is employed as the butt cap on the tennis racquet.

The tennis ball retriever device and tennis racquet of the invention will be described in connection with certain illustrated embodiments; however, it is recognized that those persons skilled in the art may make various modifications, additions, changes or improvements to the illustrated embodiments without departing from the spirit and scope of the invention.

DESCRIPTION OF THE EMBODIMENTS

Figure 6:
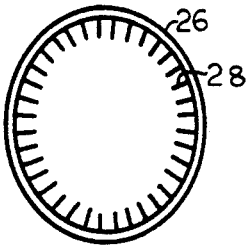
FIG. 6 is a top plan view of a molded teeth ring for use in the invention.

With reference to the drawings, there is shown a tennis ball retriever device 10 composed of an integrally molded standard cap having peripheral, octagonal walls 12 open at one end to form a truncated conical recess 14, the recess being filled with a flexible, compressible lightweight urethane foam material 16 as a compressible means, and with foam material which may have an external peripheral groove 18 designed to extend inwardly about the length of the teeth means, and of shallow depth. The retriever 10 includes a thin flexible plastic sheet 20 with an indicia logo illustrated as the letter "B" 22 on the face surface thereon for display purposes. The retriever 10 also includes a plurality of a single uniformly spaced row of metal pins 24, which pins are inserted through the peripheral wall 12 comprising the caps just below the cap wall rim to form a teeth means so as to catch or grasp the nap of a tennis ball in use. In place of the pins 24 being molded or inserted into the peripheral wall 12 of the cap, FIG. 6 shows an integrally molded one-piece plastic ring 26 containing a plurality of single rows of inwardly projecting teeth 28 which may be pressed into the open recess 14 of the cap 12 and secured in place by pressing, adhesive, or by integrally molding with the cap 12.

Figure 1:
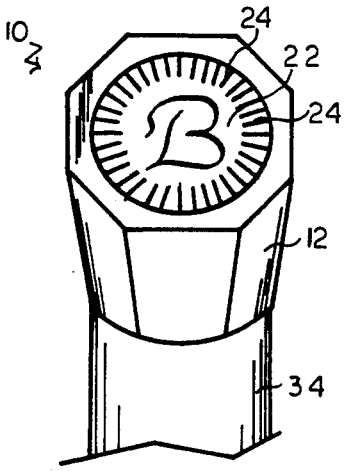
FIG. 1 is a perspective view from above of the tennis ball retriever device of the invention.
Figure 2:
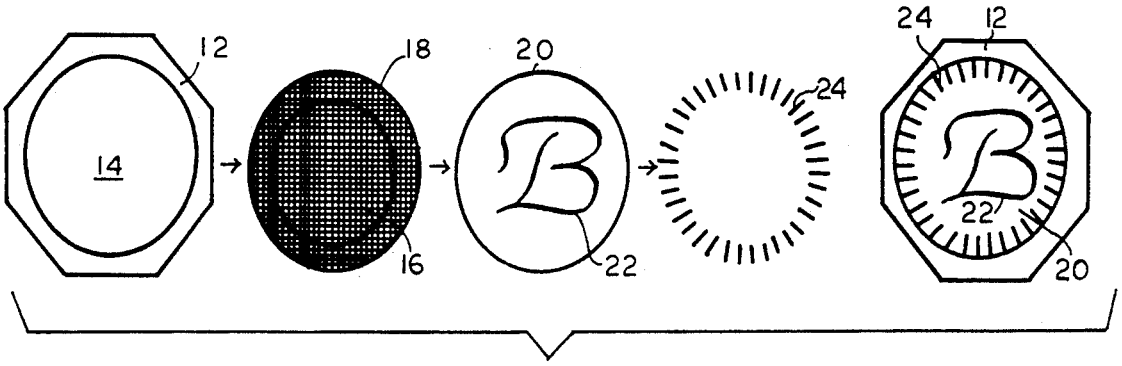
FIG. 2 is an exploded top plan view of the various components making up the tennis ball retriever of FIG. 1.
Figure 3:
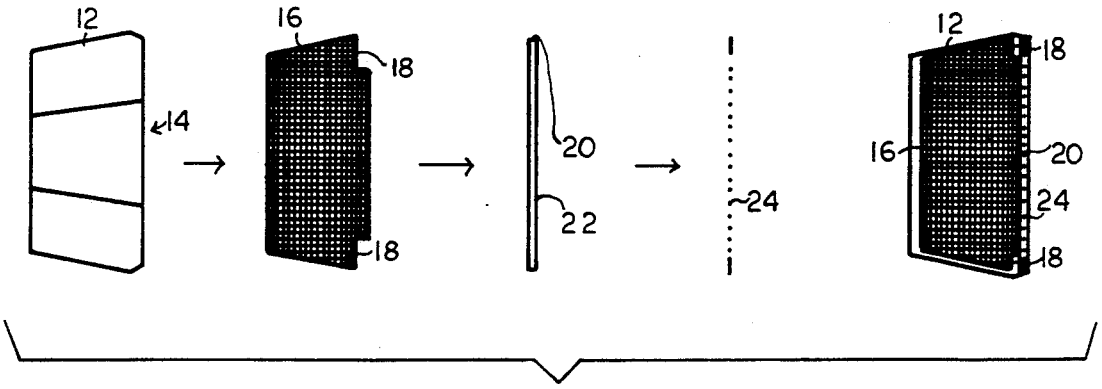
FIG. 3 is an exploded side plan view of the components of FIG. 2 of the invention.
Figure 4:
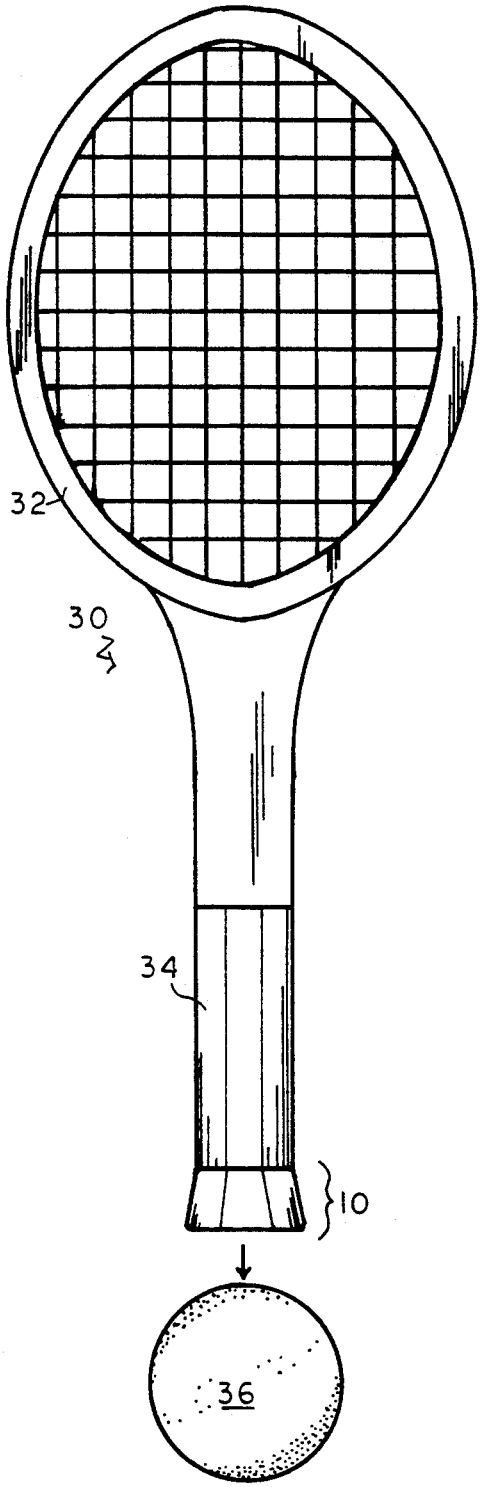
FIG. 4 is a side plan view of a tennis ball retrieval device of the invention having a tennis racquet prior to pickup of a tennis ball.
Figure 5:
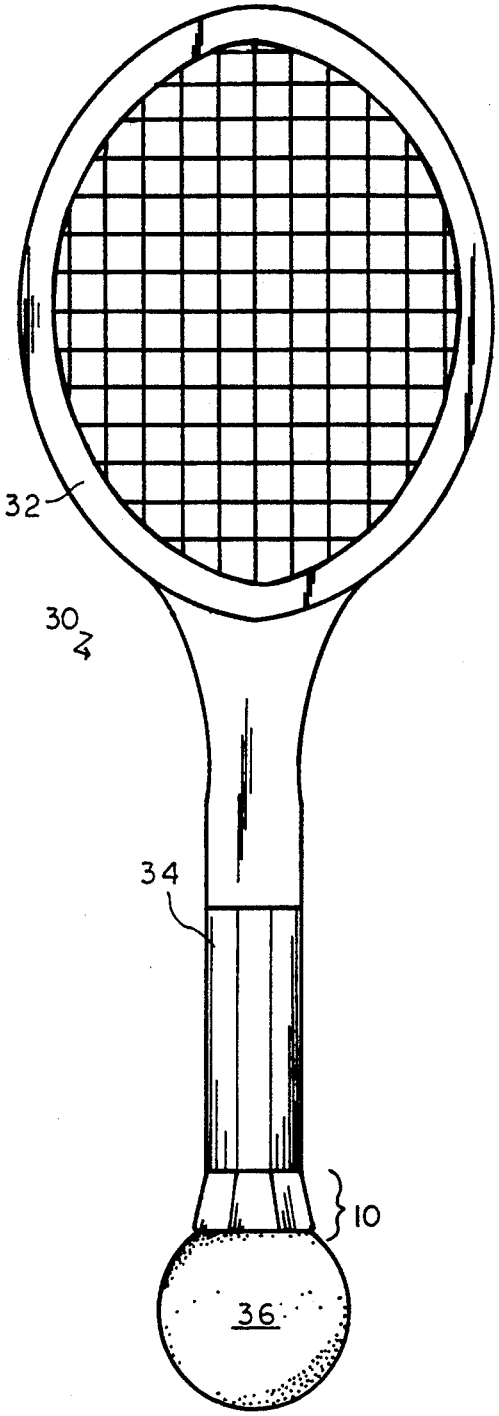
FIG. 5 is a side plan view of the invention of FIG. 4 showing the retrieval of a tennis ball.
Figure 7:
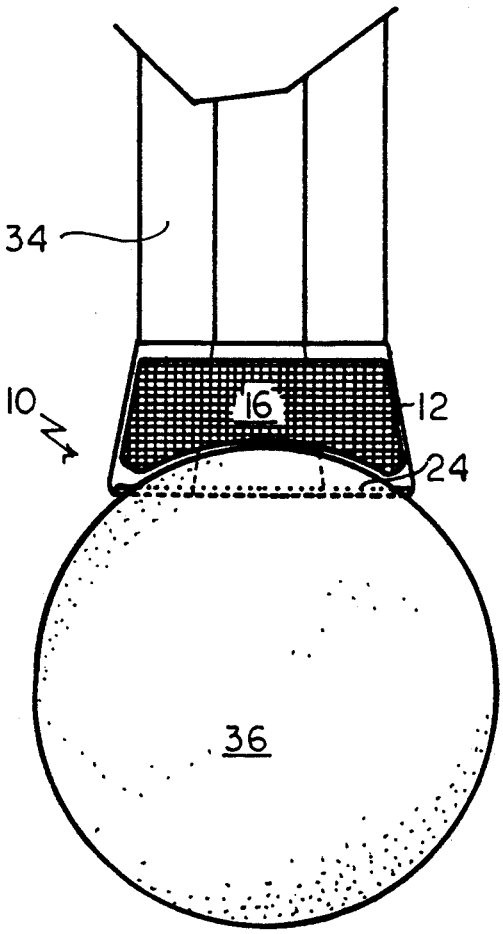
FIG. 7 is an enlarged sectional view of the tennis ball retrieval device of FIG. 5 in use.

With particular reference to FIGS. 4 and 5, there is shown a tennis racquet 30 having a head 32 and a handle section 34 with the tennis ball retrieval 10 secured in the normal manner to the handle end 34 and shown in FIG. 4 just above a tennis ball having a nap surface for retrieval. FIGS. 5 and 7 are directed to an illustration of a retrieval of a tennis ball 36 by the racquet 30 having the retriever 10 at the handle end 34, illustrating that the racquet 30 is placed over the ball 36 and lowered toward it by the user. When contact is made with the leading radius of the tennis ball 36, the foam compressible material 16 is compressed inwardly to the extent of the arcuate portion of the tennis ball's 36 diameter. This inward compressible movement uncovers the points of the pins 24 and exposes them to catch the nap of the tennis ball 36. The continued downward pressure by the user of the tennis racquet 30 with the retriever 10 entangles the tennis balls naps in the pins 24 permitting the pins to secure the ball to the retriever 10. With the ball now securely retrieved, it may be lifted from the court surface, and then removed from the retriever 10 by the user by pulling axially outwardly, whereby the compressible material 16 moves back to its original pin-protected screen position.

The tennis ball retriever device and racquet of the invention provides for the simple effective retrieval of a tennis ball without altering essential characteristics of the tennis racquet with which it is employed, and avoids the disadvantages of other tennis ball retriever devices of the prior art.

What is claimed is:

1. A tennis ball retriever device, for use at the handle end of a tennis racquet, for retrieval of tennis balls having a nap surface, which device removably grasps a tennis ball by contacting a tennis ball with the tennis ball retriever device, and which device comprises:

a) a cap, adapted to be secured to the handle end of a tennis racquet, and having an axis and having an open end with a recess defined by a peripheral wall of the cap;

b) teeth means to grasp removably the surface nap of a tennis ball, and which teeth means comprises a plurality of teeth elements, extending inwardly a short distance toward the axis of the cap from the peripheral wall of the cap and generally positioned perpendicular to the axis of the cap to grasp or catch the nap of a tennis ball in use; and c) a compressible means within the recess of the cap and extending generally to the teeth means, the compressible means adapted to move between an extended screening position which prevents casual contact of the teeth means with objects, and an inwardly compressed position created by a tennis ball to expose the teeth means and to permit the teeth means to grasp the nap of a tennis ball.

2. The device of claim 1 wherein the cap comprises an integrally molded plastic cap.

3. The device of claim 1 wherein the cap defines a generally polygonal wall and a truncated, conical recess at the one end.

4. The device of claim 1 wherein the teeth means comprises at least a single row of generally uniformly spaced teeth positioned just below the rim of the peripheral wall.

5. The device of claim 1 wherein the teeth means comprises a plastic ring having a plurality of inwardly-extending teeth therein, the plastic ring and teeth integrally molded of plastic and adapted to be inserted and secured within the recess.

6. The device of claim 1 wherein the compressible means comprises a lightweight, flexible, foam material.

7. The device of claim 1 wherein the compressible means comprises a lightweight, flexible urethane foam which foam substantially fills the recess.

8. The device of claim 1 wherein the device includes a compressible means of a lightweight, flexible foam material having an inwardly-extending groove around the periphery of the foam, generally adjacent to and extending the length of the teeth means.

9. The device of claim 1 wherein the compressible means includes on an exterior surface outwardly exposed surface indicia means for display.

10. The device of claim 1 which includes a thin sheet of lightweight flexible material containing on one surface indicia means for display, and wherein the lightweight sheet material is placed adjacent to the compressible means at an open recess end of the device.

11. A tennis racquet which comprises:

a) a tennis racquet head and a handle having a one and an other end, one end of the handle secured to the racquet head and the other end of the handle secured to a tennis ball retriever device; and b) which tennis ball retriever device comprises:

i) a cap, adapted to be secured to the handle end of a tennis racquet, and having an axis and having an open end with a recess defined by a peripheral wall of the cap;

ii) teeth means to grasp removably the surface nap of a tennis ball, and which teeth means comprises a plurality of teeth elements, extending inwardly a short distance toward the axis of the cap from the peripheral wall of the cap and generally positioned perpendicular to the axis of the cap to grasp or catch the nap of a tennis ball in use; and iii) a compressible means within the recess of the cap and extending generally to the teeth means, the compressible means adapted to move between an extended screening position which prevents casual contact of the teeth means with objects, and an inwardly compressed position created by a tennis ball to expose the teeth means and to permit the teeth means to grasp the nap of a tennis ball.

* * * * *